United States Patent [19]

Thompson et al.

[11] Patent Number: 4,704,874

[45] Date of Patent: Nov. 10, 1987

[54] HOUSEHOLD REFRIGERATOR AIR FLOW SYSTEM

[75] Inventors: James B. Thompson; Brent A. Junge, both of Louisville, Ky.

[73] Assignee: General Electric Company, Louisville, Ky.

[21] Appl. No.: 905,241

[22] Filed: Sep. 9, 1986

[51] Int. Cl.[4] ..... F25D 17/08

[52] U.S. Cl. ..... 62/187; 62/408; 62/444

[58] Field of Search ..... 62/186, 187, 408, 417, 62/444, 447; 138/37, 39; 137/875; 251/127

[56] References Cited

U.S. PATENT DOCUMENTS

| | | | |
|---|---|---|---|
| 1,144,306 | 6/1915 | Mock | 251/127 X |
| 1,411,296 | 4/1922 | Nuss | 138/37 |
| 1,468,539 | 9/1923 | McCune et al. | 138/37 X |
| 1,794,640 | 3/1931 | Owens | 251/127 X |
| 1,856,492 | 5/1932 | Marshall | 251/127 X |
| 3,004,400 | 10/1961 | Mann et al. | 62/156 |
| 3,004,401 | 10/1961 | Mann et al. | 62/156 |
| 3,283,528 | 11/1966 | Palm et al. | 62/187 |
| 3,320,761 | 5/1967 | Gelbard | 62/180 |
| 3,455,119 | 7/1969 | Bright | 62/180 |
| 3,575,011 | 4/1971 | Dill et al. | 62/408 |
| 3,630,046 | 12/1971 | Boor | 62/408 |
| 3,793,847 | 2/1974 | Scarlett et al. | 62/190 |
| 4,122,687 | 10/1978 | McKee | 62/187 X |
| 4,229,945 | 10/1980 | Griffin et al. | 62/229 |
| 4,509,550 | 4/1985 | Monk | 374/148 X |

*Primary Examiner*—William E. Tapolcai
*Attorney, Agent, or Firm*—Frederick P. Weidner; Radford M. Reams

[57] ABSTRACT

An air flow system for a refrigerator having a refrigeration system including a condenser, evaporator, compressor, and thermostatic control. A freezer compartment is located at the top of the refrigerator and a fresh food compartment is located below the freezer compartment with the compartments being separated by a partition. An area above the fresh food compartment contains the evaporator and a fan for circulating air through the evaporator, which fan cycles on when the compressor is operating and off when the compressor is not operating. The air flow system includes an air duct having an upper end to receive cold air from the evaporator and a lower end having an air flow control assembly located in the fresh food compartment for discharging cold air into the fresh food compartment. The lower end of the air duct has an upper wall with a downwardly projecting depending flange with a terminal end and a lower wall having an upwardly projecting depending flange with a terminal end, said terminal ends of the flanges being spaced from each other in the vertical plane. This structural arrangement reduces the amount of natural convection heat transfer that takes place between the evaporator area and fresh food compartment of the refrigerator when the evaporator fan is not operating.

7 Claims, 4 Drawing Figures

HOUSEHOLD REFRIGERATOR AIR FLOW SYSTEM

BACKGROUND OF THE INVENTION

This invention relates to household refrigerators and is more particularly concerned with a combination refrigerator, that is, a refrigerator including a freezer compartment on top and a fresh food compartment below, both of which are cooled by circulation air over a single evaporator employing a single fan to accomplish the circulation. This invention relates to an air flow system for reducing the amount of natural convection heat transfer that takes place between the area around the evaporator and the fresh food compartment when the evaporator fan is not operating.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment.

Various means have been used or proposed for providing temperature control employing a single thermostat for maintaining the two compartments within their desired operating temperature ranges. Such means of control are described in U.S. Pat. Nos. 3,320,761 and 4,229,945. Generally, thermostatic control of the evaporator is achieved by using an air temperature sensing element in the warmer fresh food compartment. The air from the evaporator is divided by appropriate structure with about 80–90 percent going to the freezer compartment from the evaporator area and about 10–20 percent to the fresh food compartment, to thus provide the desired temperature differential between the freezer and fresh food compartments.

The air flow from the evaporator area to the fresh food compartment is by a duct that receives cold air from the evaporator and discharges it into the fresh food compartment through an air flow control assembly in the fresh food compartment. The air flow control assembly may be adjusted during a particular ambient atmospheric condition, for example, 70° F.; however, satisfactory temperature control may not be acheived at a higher ambient atmospheric temperature, for example, 100° F., due to the unequal proportion of heat flow into the fresh food compartment. In the higher ambient temperatures, the heat flow from the ambient into the fresh food compartment is higher relative to the freezer compartment than in low ambient temperatures. This can be remedied by increasing the amount of cold air flowing into the fresh food storage compartment in higher ambients. Such changes in usage conditions may be accommodated by including a manually-operable fresh food compartment air flow adjustment such as a damper. There may also be a temperature sensing means located adjacent the cold air duct upstream of the damper that controls the operation of the compressor and evaporator. When the temperature sensed by the temperature sensing means located in the fresh food compartment reaches a pre-selected elevated temperature, there are electrical means for turning on the compressor which in turn will operate the evaporator and turn on the evaporator fan along with the compressor to increase the flow of cold air.

It has been found that when the evaporator fan is not operating there results natural convection heat transfer between the evaporator area and fresh food compartment which decreases the amount of controlled forced air flow to the fresh food compartment, thus detrimentally affecting temperature control repeatability of the refrigeration system. Such natural convection heat transfer also increases the amount of cross-ambient compensation which is undesirable. Cross-ambient compensation means that there is a temperature differential change from one ambient temperature (90° F.) to another (70° F.) in each of the fresh food and freezer compartments. Ideally, the less cross-ambient temperature differential the better. By this invention there is a reduction in these undesirable characteristics in a household refrigerator refrigeration system.

SUMMARY OF THE INVENTION

There is provided in a refrigerator having a refrigeration system including a condenser, evaporator, compressor, and thermostatic control an air flow system having a freezer compartment at the top of the refrigerator, a fresh food compartment below the freezer compartment and separated from the freezer compartment by a partition. An area above the fresh food compartment contains the evaporator and a fan for circulating air through the evaporator, said fan cycling on when the compressor is operating and off when the compressor is not operating. There is an air duct having an upper end to receive cold air from the evaporator and a lower end having an air flow control assembly located in the fresh food compartment for discharging cold air into the fresh food compartment. The lower end of the air duct has an upper wall with a downwardly projecting depending flange with a terminal end and a lower wall having an upwardly projecting depending flange with a terminal end, said terminal ends of the flanges being spaced from each other in the vertical plane. With this arrangement when the evaporator fan is not operating, cold air falling from the evaporator above the fresh food compartment through the air duct by natural convection will be reduced by the upwardly projecting depending flange in the lower wall of the air duct and warm air from the fresh food compartment flowing upwardly through the air duct by natural convection will be reduced by the downwardly projecting depending flange in the upper wall of the air duct.

DESCRIPTION OF THE PREFERRED EMBODIMENT

Figure 1:
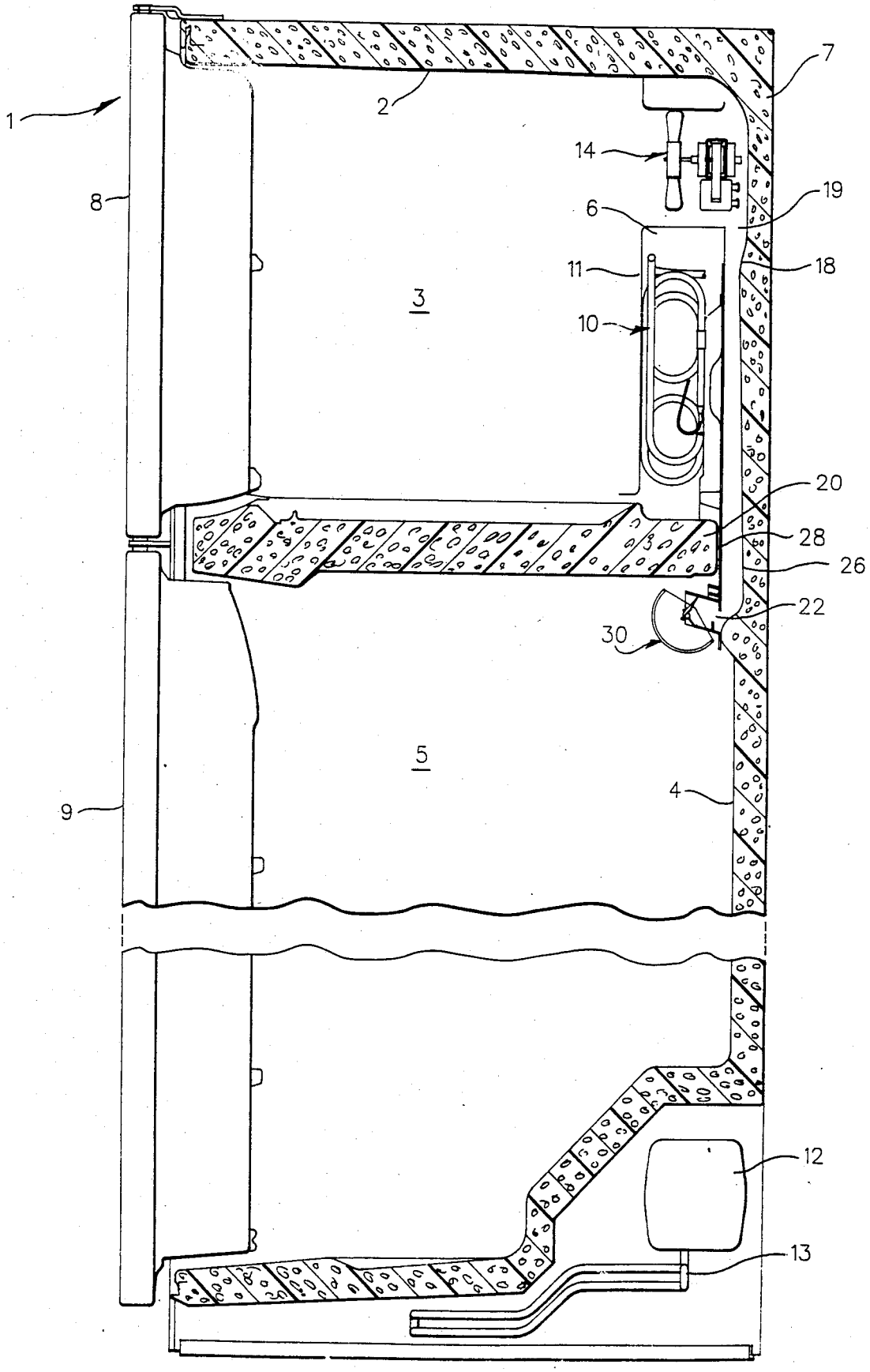
FIG. 1 is a side elevational view of a refrigerator having a freezer compartment on top and a fresh food compartment on the bottom with parts broken away and embodying the present invention.

With reference to FIG. 1 of the drawings, there is illustrated a refrigerator cabinet including an outer case 1, an upper inner liner 2 defining a freezer compartment 3 and a lower inner liner 4 defining a fresh food compartment 5 separated from the freezer compartment by a partition 20. The spaces between the liners and the outer case are filled with suitable insulating material 7. The access openings to the freezer and fresh food compartments are respectively closed by doors 8 and 9.

Refrigeration for the two compartments is provided by an evaporator 10 positioned in an area 6 above the fresh food compartment and in the preferred embodiment is at the rear of the freezer compartment and separated from the food storage area of the freezer by a wall 11. The evaporator 10 forms part of the refrigeration system including compressor 12 and a condenser 13 located at the bottom of the refrigerator. A fan 14 above the evaporator 10 provides means for ciculating air from the two compartments over the evaporator 10 and back into the compartments. As shown and described in U.S. Pat. No. 4,229,945 the evaporator 10 and fan 14 may be located in the partition 20 above the fresh food compartment 5.

Figure 2:
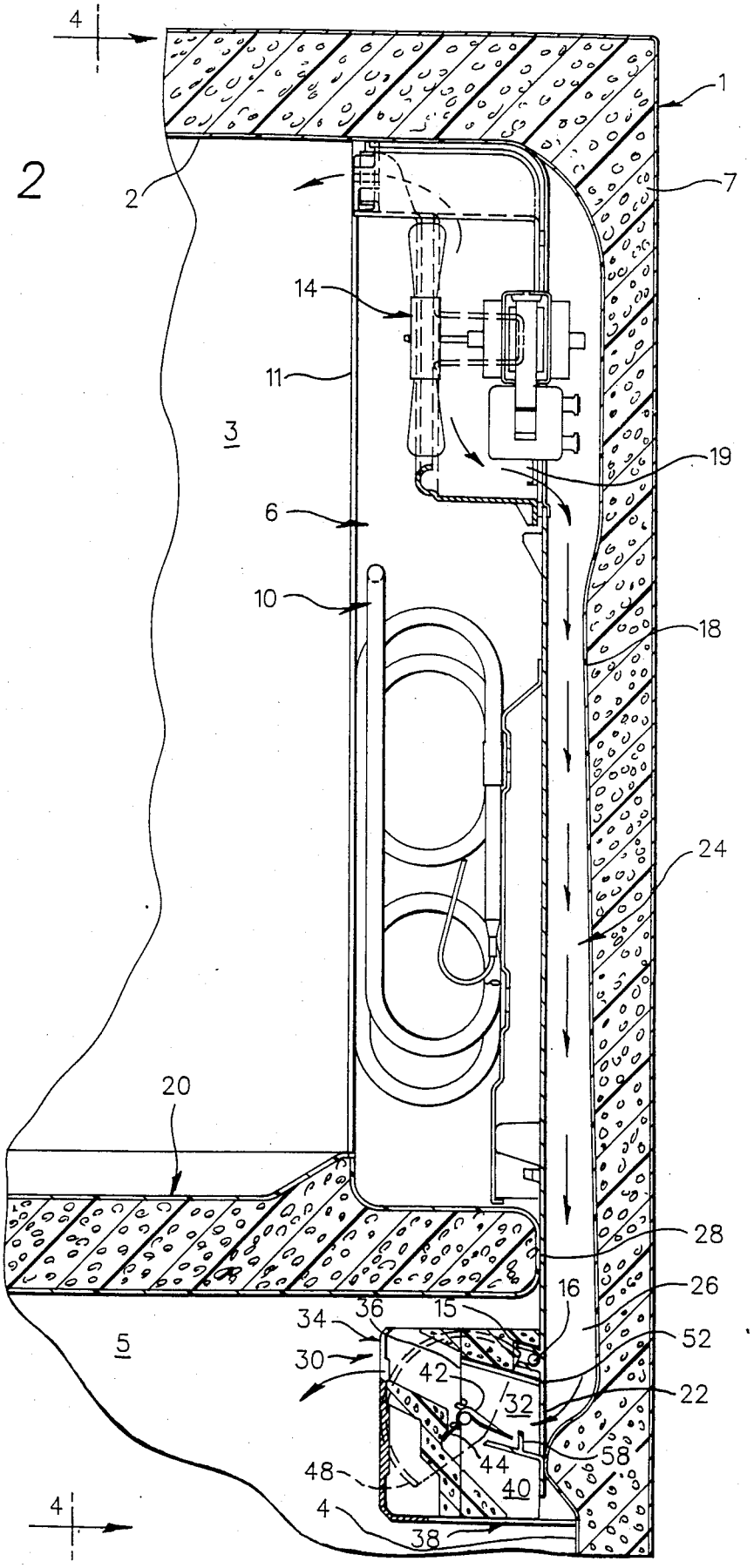
FIG. 2 is a side elevational view, partly in section, of a refrigerator cabinet having a freezer compartment on top and a fresh food compartment on the bottom showing in enlarged view one form of the present invention as embodied therein.
Figure 4:
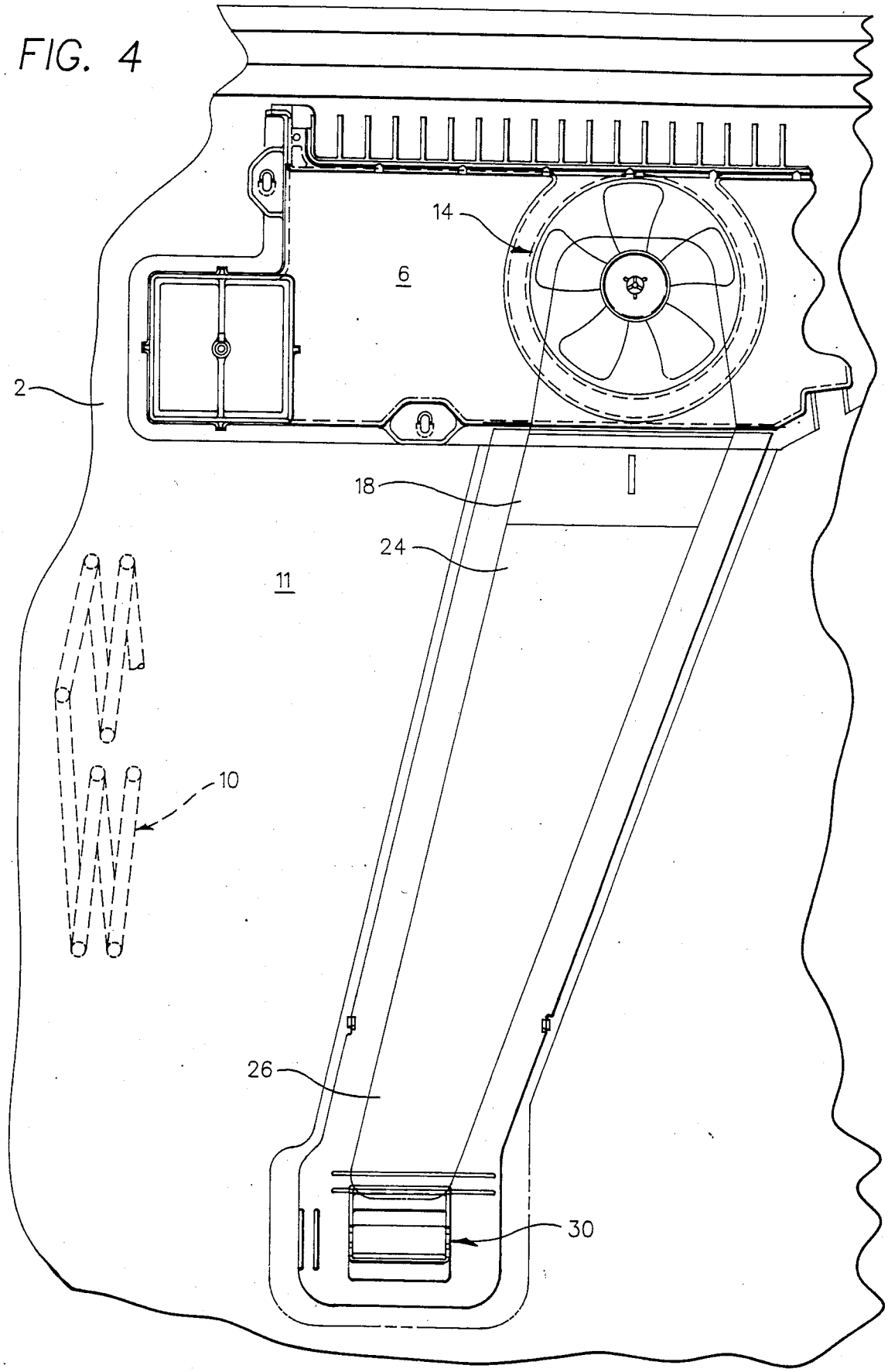
FIG. 4 is a front elevational view taken along lines 4—4 of FIG. 2 and embodying the present invention.

With reference to FIGS. 1 and 2, in the operation of the refrigerator the fan 14 operates to pull air across the cold evaporator 10 which air enters the evaporator area 6 upstream of the evaporator 10. Most of the air which is cooled by passing over the evaporator 10 is fan forced into the freezer compartment 3 and the rest of the cooled air flows into an air duct 24 connecting the evaporator area 6 and fresh food compartment as shown by arrows in FIG. 2. The air duct 24 may be molded from suitable plastic material and in the preferred embodiment it has an open back and fits in a complementary recess area in the upper inner liner 2 which in effect acts as the back wall of the air duct. The air duct as shown in FIG. 4 may be wider at the top than the bottom and may be held in place in any suitable manner including using the rear edge portion 28 of the partition 11 as shown in FIG. 2. The air duct 24 has an upper end 18 with an opening 19 to receive cold air from the evaporator and a lower end 26 having an air flow control assembly 30 located in the fresh food compartment for introducing cold air into the fresh food compartment 5. The cold air being discharged into the fresh food compartment 5 is divided by means of the air flow control assembly 30 so that a portion of the cold air from the air duct is directed to the top of the fresh food compartment and a portion is directed downwardly to the bottom of the fresh food compartment.

Figure 3:
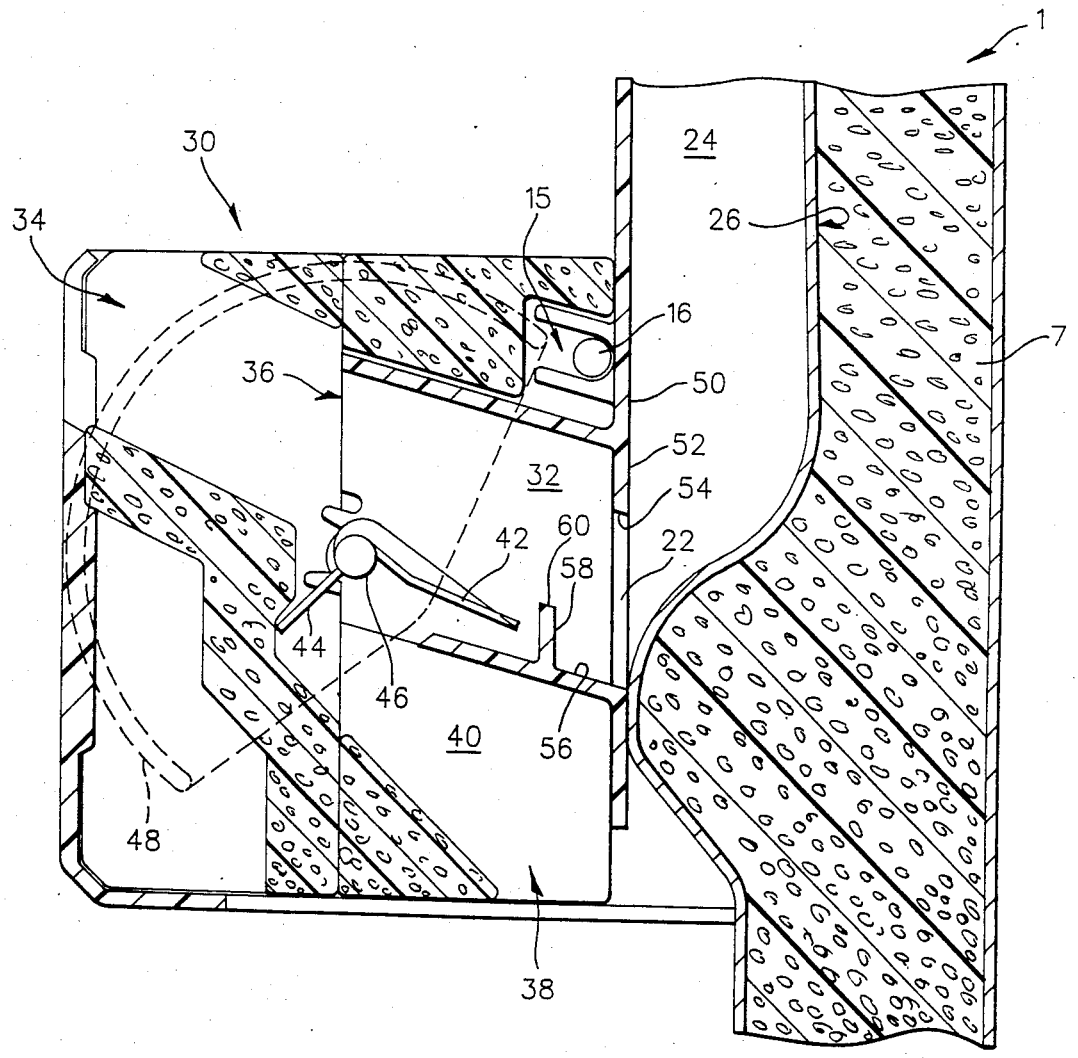
FIG. 3 is a cross-sectional view of the air flow control assembly including the lower end of the air duct embodying the present invention.

With particular reference to FIG. 3, the air flow control assembly 30 is shown in cross-sectional detail and it is positioned within the fresh food compartment 5 in close proximity to the partition 20 dividing the freezer and fresh food compartments 3 and 5 respectively. The cold air passing downwardly through air duct 24 enters the air flow control assembly 30 through opening 22 into an air chamber 32. The air flow control assembly 30 has a first opening 34 for directing a portion of the stream of cold air into the top of the fresh food compartment. There is a first air passage 36 from the chamber 32 to the first opening 34. The air flow control assembly 30 also includes a second opening 38 for directing a portion of the stream of cold air downwardly into the bottom of the fresh food compartment and a second air passage 40 from the chamber 32 to the second opening 38.

To control the amount of cold air being divided between the first opening and second opening respectively, there is provided in the air flow control assembly an air flow control having a first damper 42 and a second damper 44 attached to a rotatable axle 46. The dampers 42 and 44 are spaced from each other and are stationarily fixed to the axle 46 such that when the first damper 42 blocks the first air passsge 36, the second damper 44 is in position to block the second air passage 40. At one end of the axle 46, there is a dial 48 accessible from the interior of the fresh food compartment 5 to allow an operator to manually rotate the dial which, in turn, rotates the axle and the attached dampers. By such manual rotation, the amount of air being directed through the respective first and second openings 36 and 38 may be easily controlled. In effect, then, the air flow control operates as a metering device to adjust the amount of cold air being directed to the top of the fresh food compartment and to the bottom of the fresh food compartment. The first opening 34 and passage 36 are larger in dimension than the second opening 38 and passage 40 so that a larger amount of the cold air will be discharged into the top of the fresh food compartment relative to the cold air being discharged into the bottom of the fresh food compartment. Generally speaking, the amount of total cold air being discharged through the first opening 34 is approximately two times the amount of cold air being discharged through the second opening 38.

It will be appreciated that counter clockwise movement of the axle 46 and dampers 42 and 44 as viewed in FIG. 3 will reduce the amount of air passing into the air flow control assembly through opening 22 of the air duct. Conversely, clockwise movement of the axle 46 and dampers 42 and 44 will increase the amount of air being introduced into the air flow control assembly.

A temperature control thermostat generally indicated by the numeral 15, including a temperature sensing element 16 (FIG. 3), is provided for automatically controlling the operation of the compressor 12 to control the temperature of the refrigerator. The temperature sensing element 16 is located at the top near the air flow control assembly 30 and is shielded from the stream of cold air passing through the air duct 24. Operation of the refrigerating system and fan causes air from both the freezer compartment 3 and the fresh food compartment 5 to pass over the cold evaporator 10 and be introduced back into the freezer compartment 3 and fresh food compartment 5. The method of controlling the refrigerator temperature by locating the temperature sensing element 16 at the top of the fresh food compartment 5 and shielding the temperature sensing element from the stream of cold air being directed into the fresh food compartment through the air duct allows the thermostat to sense the temperature of a mixture of the fresh food compartment temperature and the temperature of the cold air flowing through the air flow control assembly. When a predetermined elevated temperature is sensed, the control system starts the compressor and turns on the evaporator fan to reduce the refrigerator temperature. The cooperation or interaction between the temperature sensing element 16 and its shielding structural arrangement, together with the proportionate control of the stream of cold air being directed to the top and to the bottom of the fresh food compartment, will cause the temperature in the freezer compartment to be either raised or lowered and the temperature difference between the fresh food compartment temperature and the freezer temperature will be changed so that the fresh food compartment temperature remains relatively constant.

The above-described control system for a household refrigerator works quite well; however, it has been found that control of the refrigeration system can be detrimentally affected as a result of natural convection heat transfer that takes place between the evaporator area and the fresh food compartment when the evaporator fan is not operating. Cold air is heavier than warm air and thus it tends to flow by natural convection downwardly while warm air tends to flow upwardly. In the case of the air duct 24, when the evaporator fan 14 is off cold air has a tendency to flow from the evaporator area and freezer compartment downwardly through the upper end of the air duct 18 to the lower end of the air duct while warm air from within the fresh food compartment has a tendency to flow upwardly through the air flow control assembly entering the air duct 24 at the lower end 26 and flowing upwardly through the air duct to the evaporator area and freezer compartment. As a result of such natural convection heat transfer by the flowing of the cold air downwardly and the warm air upwardly in the air duct to the fresh food and freezer compartments, it reduces the amount of controlled fan forced air to the fresh food compartment and therefore detrimentally affects temperature control repeatability. That is, in providing the correct air flow system within a household refrigerator it is important that the components control the amount of fan forced air to the various compartments in a controlled manner. Therefore, it is helpful in a refrigeration air flow system to eliminate or at least reduce the amount of uncontrolled air flow from one compartment to another. In addition, this uncontrolled natural convection heat transfer between the evaporator area and freezer compartment and the fresh food compartment tends to increase the amount of cross-ambient compensation of each of the freezer and fresh food compartments. It is desirable that cross-ambient compensation variation should be as little as possible. That is, when going from a 90° atmospheric ambient to a 70° atmospheric ambient, the temperature within the freezer compartment and in the fresh food compartment should have a minimum amount of temperature change respectively regardless of the atmospheric ambient. It is therefore the object of this invention to reduce the amount of natural convection heat transfer that takes place between the evaporator area and the fresh food compartment when the evaporator fan is inoperative.

With reference particularly to FIGS. 2 and 3, the amount of natural convection heat transfer is reduced by providing at the lower end of the air duct located in the fresh food compartment an upper wall 50 with a downwardly projecting depending flange 52 with a terminal end 54. The air duct 24 has a lower wall 56 having an upwardly projecting depending flange 58 with a terminal end 60. The terminal ends 54 and 60 are spaced from each other in the vertical plane, thus allowing air flow through the opening 22 in the lower end 26 of the air duct 24 when the evaporator fan is operating. As shown in FIGS. 2 and 3, the terminal ends 54 and 60 and the downwardly projecting depending flange 52 and the upwardly projecting depending flange 58 may also be spaced from each other in the horizontal plane. It will be appreciated that any cold air falling down the air duct by natural convection when the evaporator fan is not operating will be blocked from passing into the air chamber 32 of the air flow control assembly 30 by flange 58. Any warm air that has a tendency to flow by natural convection through the air flow control assembly and upwardy into the air duct 24 will be blocked by the downwardly projecting depending flange 52.

The length of the projecting depending flanges 52 and 58 should be such to cooperate with each other to maximize resistance to natural convection of air through the air duct when the evaporator fan is not operating without detrimentally affecting the air flow system when the evaporator fan is operating. It has been found that in some refrigerators with this arrangement the cross-ambient compensation can be reduced in the fresh food compartment about 1.2° F.

The foregoing is a description of the preferred embodiment of the invention and it should be understood that variations may be made thereto without departing from the true spirit of the invention as defined in the appended claims.

What is claimed is:

1. In a refrigerator having a refrigeration system including a condenser, evaporator, compressor, and thermostatic control an air flow system comprising:

a freezer compartment at the top of the refrigerator, a fresh food compartment below the freezer compartment and being separated therefrom by a partition, an area above the fresh food compartment containing the evaporator, a fan for circulating air through the evaporator, said fan cycling on when the compressor is operating and off when the compressor is not operating, an air duct having an upper end to receive cold air from the evaporator and a lower end having an air flow control assembly located in the fresh food compartment for discharging cold air into the fresh food compartment, said air duct lower end having an upper wall with a downwardly projecting depending stationary flange with a terminal end and a lower wall having an upwardly projecting depending stationary flange with a terminal end, said terminal ends of the flanges being spaced from each other in the vertical plane.

2. In the refrigerator of claim 1 wherein the terminal ends of the flanges are spaced from each other in the horizontal plane.

3. In the refrigerator of claim 1 wherein the downwardly projecting depending flange and the upwardly projecting depending flange cooperate to maximize resistance to natural convection of air through the air duct when the evaporator fan is not operating without detrimentally affecting the air flow system when the evaporator fan is operating.

4. In the refrigerator of claim 1 wherein the area above the fresh food compartment containing the evaporator is located between the freezer compartment and back wall of the refrigerator.

5. In the refrigerator of claim 4 wherein the fan is located above the evaporator and the air duct is at the rear of the area containing the evaporator and extends downwardly behind the evaporator and between the partition and back wall of the refrigerator.

6. In the refrigerator of claim 1 wherein the thermostatic control includes a temperature sensing element located at the lower end of the air duct in temperature sensing relationship with the fresh food compartment.

7. In the refrigerator of claim 6 wherein the temperature sensing element is located in the air flow control assembly and the air flow control assembly has means to divide the cold air entering the fresh food compartment between the top of the compartment and the bottom of the compartment.

* * * * *